US005462126A

United States Patent [19]

Wallace

[11] Patent Number: 5,462,126

[45] Date of Patent: Oct. 31, 1995

[54] GROUND ROD DRIVER

[76] Inventor: James D. Wallace, P.O. Box 689, Athens, Tenn. 37303

[21] Appl. No.: 231,922

[22] Filed: Apr. 25, 1994

[51] Int. Cl.[6] ..... B25D 17/08

[52] U.S. Cl. ..... 173/53; 173/90; 173/129

[58] Field of Search ..... 173/90, 91, 53, 173/54, 55, 92, 129, 132, 185, 184; 227/147; 279/77, 83

[56] References Cited

U.S. PATENT DOCUMENTS

| | | | |
|---|---|---|---|
| 54,836 | 5/1866 | Abbott | 173/55 |
| 101,746 | 4/1870 | Lewis | 173/55 |
| 267,732 | 11/1882 | Warfield | 279/83 |
| 1,516,602 | 11/1924 | Hill | 279/77 |
| 1,998,188 | 4/1935 | Dunn | 279/77 |
| 4,002,210 | 1/1977 | White | 173/53 |
| 4,790,392 | 12/1988 | Clements | 173/90 |
| 5,049,013 | 9/1991 | Engles et al. | 279/77 |
| 5,167,288 | 12/1992 | McNeil et al. | 173/55 |

*Primary Examiner*—Scott A. Smith

[57] ABSTRACT

An ground rod driver including a tubular ground rod receiver engaging a prime mover at one end and having a ratcheting ground rod driving member and a clamping setscrew disposed at an opposite end wherein a ground rod may be inserted, clamped at an initial position and subsequently be driven by releasing clamp forces and operating the prime mover in a repetitive series of downward thrusting moves whereby the ground rod is installed. The clamping setscrew of the ground rod driver may be additionally employed to remove embedded ground rods by clamping an exposed end of an embedded ground rod to the ground rod receiver wherein the prime mover extracts the ground rod from the earth by repetitively performing an upward motion followed by clamp release, and a downward motion followed by reclamping until the ground rod is freed from the earth.

1 Claim, 4 Drawing Sheets

GROUND ROD DRIVER

BACKGROUND OF THE INVENTION

1. Field of the Invention

The present invention relates to electrical grounding systems installation and more particularly pertains to a ground rod driver which may be employed to install electrical grounding rods in the earth.

2. Description of the Prior Art

The use of ground rod drivers is known in the prior art. More specifically, ground rod drivers heretofore devised and utilized for installing electrical grounding rods in the earth are known to consist basically of familiar, expected and obvious structural configurations, notwithstanding the myriad of designs encompassed by the crowded prior art which have been developed for the fulfillment of countless objectives and requirements.

The present invention is directed to improving devices for a ground rod driver in a manner which is safe, secure, economical and aesthetically pleasing.

For example, U.S. Pat. No. 4,460,050 to Schmidt discloses a pipe driving attachment wherein a plurality of concentric tapering sleeves are arranged in driving engagement with a pipe end. A hammer applies driving force to the sleeves thereby driving the pipe so engaged. The Schmidt invention is unsuitable for driving grounding rods wherein a typical grounding rod comprises a solid cylinder and not a pipe. The present invention does not require hammers or other impact forms of driving means.

In U.S. Pat. No. 5,174,388 to Williams et al. a driver tool and method is disclosed. The Williams invention comprises a series of slidably engaging rectangular cross section hollow tubes forming a mast of diminishing minor dimensions having several pivotal pusher plates affixed therein to an outermost tube and having an elongated slot disposed axially along an inner tube. A rod member is placed within the innermost tube and pusher plates selectively engage an end of the rod member thereby permitting insertion of the rod member into the ground by application of force to the outermost tube by a prime mover. A spring loaded detent is provided at the base of the innermost tube to prevent a rod member disposed therein from falling free. The Williams invention has discrete depth increments generally limited to three and additionally only applies force to the free end of the rod member. The substantial separation of force application site and earth engagement portion of the rod member tends to buckle the rod member and may result in release of the rod member through the elongated slot or in aborting attempts to insert rod members in hard soils. And furthermore, the Williams invention is limited in installing relatively short lengths of rod member and requires an interconnection device to enable installation of lengths such as the twenty foot long rod use for grounding 345 KV wood k-frame power transmission structures. Also there is no provision for removing earth embedded rod members in the Williams invention. The present invention comprises a single tubular member housing the rod member and employs a threadedly engaging clamping means to prevent the rod member from falling free. The threadedly engaging clamping means also enables removal of existing rod members by pulling using a prime mover. The present invention applies force of a prime mover to the rod member as proximate to the earth surface as desired, the sole disadvantage being an increase in a number of cycles required to complete installation. Having the force application site in close proximity to the earth permits application of significantly greater driving force than possible in the Williams invention without danger of buckling the rod member.

In U.S. Pat. No. 4,315,551 to Iannone a rod driver is described wherein an elongate body having a longitudinal bore terminating in a concave blind end is placed over a rod member free end and is impacted thereby driving the rod member into the earth. The Iannone invention has no provision for removing embedded rod members, is limited to installation of relatively short rod members, and is not adaptable for non impact installation using a prime mover such as a backhoe. The present invention enables removal of embedded rod members and provides for non impact installation of long rod members by prime movers.

In U.S. Pat. No. 5,188,187 to Mumper an electrical grounding rod driving bit is disclosed for interfacing an externally powered impact hammer to a free end of a ground rod member. A disadvantage in this prior art lies in a lack of provision for installing long grounding rods such as the twenty foot rod employed for high tension transmission system grounding. Also there is no guide to hold the rod member and the rod is further susceptible to buckling when installation is to be performed in hard earth compositions. The present invention permits installation of long grounding rods and is not susceptible to buckling of the rod member. And the present invention requires no impact driving techniques and furthermore permits rapid removal of embedded rod members.

U.S. Pat. No. 4,557,409 to Hecock et al. discloses an electrical grounding rod driving device. The disclosure teaches a double headed hammer slidably engaging a grounding rod wherein one hammer head initiates and continues insertion of the grounding rod and a second hammer head completes the insertion of the rod. The Hecock et al. invention requires preparation of a hole twelve to fifteen inches deep and is substantially limited to grounding rods to eight foot length. The disclosure makes no provision for removal of an embedded grounding rod and additionally drives a ground rod using impact force. Furthermore, there are no provisions to prevent buckling of the ground rod when attempting installation in hard earth compositions. The present invention requires no prior earth preparation unless indicated by code and is generally unrestricted in driven rod length. The present invention also permits extraction of an embedded grounding rod at any time after installation and in situations arising when a grounding rod strikes a rock ledge and must be repositioned.

In this respect, the ground rod driver according to the present invention substantially departs from the conventional concepts and designs of the prior art, and in so doing provides an apparatus primarily developed for the purpose of installing grounding rods.

Therefore, it can be appreciated that there exists a continuing need for new and improved ground rod driver which can be engagingly disposed with a prime mover to quickly embed grounding rods in various earth compositions. In this regard, the present invention substantially fulfills this need.

As illustrated by the background art, efforts are continuously being made in an attempt to improve grounding rod installation apparatus. No prior effort, however, provides the benefits attendant with the present invention. Additionally, the prior patents and commercial techniques do not suggest the present inventive combination of component elements arranged and configured as disclosed and claimed herein.

The present invention achieves its intended purposes, objects, and advantages through a new, useful and unobvious combination of method steps and component elements, with the use of a minimum number of functioning parts, at a reasonable cost to manufacture, and by employing only readily available materials.

SUMMARY OF THE INVENTION

In view of the foregoing disadvantages inherent in the known types of ground rod drivers now present in the prior art, the present invention provides an improved ground rod driver construction wherein the same can be utilized for installing grounding rods in various earth compositions. As such, the general purpose of the present invention, which will be described subsequently in greater detail, is to provide a new and improved ground rod driver apparatus and method which has all the advantages of the prior art ground rod driver and none of the disadvantages.

The invention is defined by the appended claims with the specific embodiment shown in the attached drawings. For the purpose of summarizing the invention, the invention may be incorporated into an elongated tubular member having a prime mover engagement portion at one end thereof and a ground rod engagement apparatus disposed at an opposite end. The ground rod engagement apparatus comprises a releasable toothed cam member and a clamping setscrew engaging a ground rod disposed within the elongated tubular member. The releasable toothed cam member engages the ground rod affixing the rod to the tubular member during application of force by a prime mover in the direction of the earth surface. Subsequently the prime mover releases force and may be retractably disposed wherein the cam member disengages from the ground rod thereby permitting the prime mover to lift the tubular member to an increased elevation where force may again be applied thereby pushing the ground rod into the earth. The clamping setscrew is employed to frictionally engage the ground rod when first installed within the tubular member thereby preventing free fall, and additionally to affix the ground rod to the tubular member thereby permitting the prime mover to extract the ground rod from the earth.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In as much as the foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the disclosed specific methods and structures may be readily utilized as a basis for modifying or designing other structures for carrying out the same purposes of the present invention. It should be realized by those skilled in the art that such equivalent methods and structures do not depart from the spirit and scope of the invention as set forth in the appended claims.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

Therefore, it is an object of the present invention to provide an improved ground rod driver capable of installing ground rods deeply within substantially hard earth compositions.

It is therefore an additional object of the present invention to provide a new and improved ground rod driver which has all the advantages of the prior art ground rod drivers and none of the disadvantages.

It is another object of the present invention to provide a new and improved ground rod driver which may be easily and efficiently manufactured and marketed.

It is a further object of the present invention to provide a new and improved ground rod driver which is of a durable and reliable construction.

An even further object of the present invention is to provide a new and improved ground rod driver which is susceptible of a low cost of manufacture with regard to both materials and labor, and which accordingly is then susceptible of low prices of sale to the consuming public, thereby making such ground rod drivers economically available to the buying public.

Still yet another object of the present invention is to provide a new and improved ground rod driver which provides in the apparatuses and methods of the prior art some of the advantages thereof, while simultaneously overcoming some of the disadvantages normally associated therewith.

Still another object of the present invention is to provide a new and improved ground rod driver which may be driven by a variety of prime movers commonly employed in the construction industry.

Yet another object of the present invention is to provide a new and improved ground rod driver which may be employed to extract embedded ground rods in new and existing construction.

Even still another object of the present invention is to provide a new and improved ground rod driver which permits installation of both short and long ground rods wherein a long ground rod may be at least twenty feet in length and may further comprise more than a single section there being a coupling device installed between shorter sections.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention. The foregoing has outlined some of the more pertinent objects of this invention. These objects should be construed to be merely illustrative of some of the more prominent features and applications of the present invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
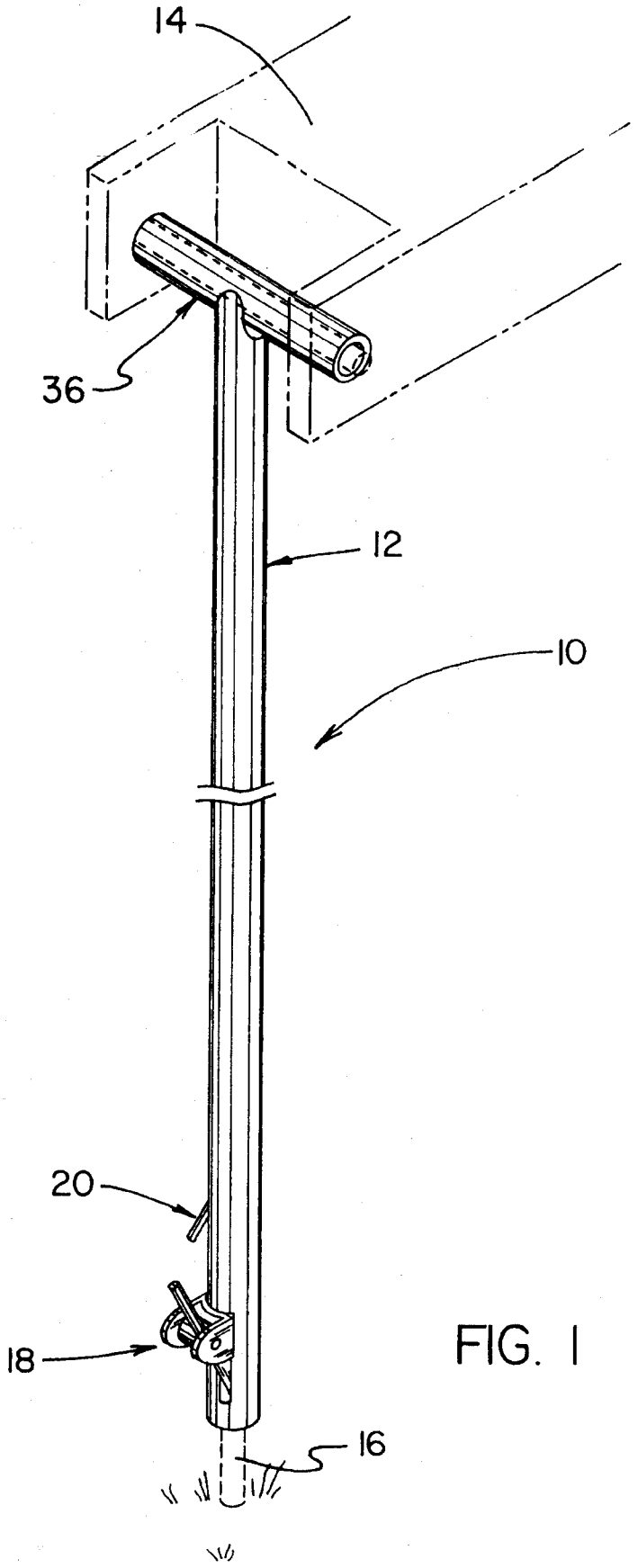
FIG. 1 is a perspective view of the ground rod driver showing an operational disposition with a prime mover.

With reference now to the drawings, and in particular to FIG. 1 thereof, a new and improved ground rod driver embodying the principles and concepts of the present invention and generally designated by the reference numeral 10 will be described. From an overview standpoint, the ground rod driver is adapted for use with grounding rods and a prime mover to embed ground rods deeply within the earth's crust for the purpose of producing an electrical ground for electrical apparatus. See FIG. 1. The ground rod driver 10 comprises an elongated tubular ground rod receiver 12 detachably affixed to a prime mover 14 and engaging ground rod 16 wherein the ground rod 16 is slidably positioned within the tubular ground rod receiver 12 and furthermore permitted to slidably move in only one of two substantially axially aligned directions by ground rod engaging assembly 18. Clamping setscrew 20 frictionally engages the ground rod 16 to generate an initial ground rod position within tubular ground rod receiver 12, and additionally to provide attachment of the ground rod 16 to the tubular ground rod receiver 12 thereby permitting extraction of an installed ground rod 16 from the earth using prime mover 14.

Figure 2:
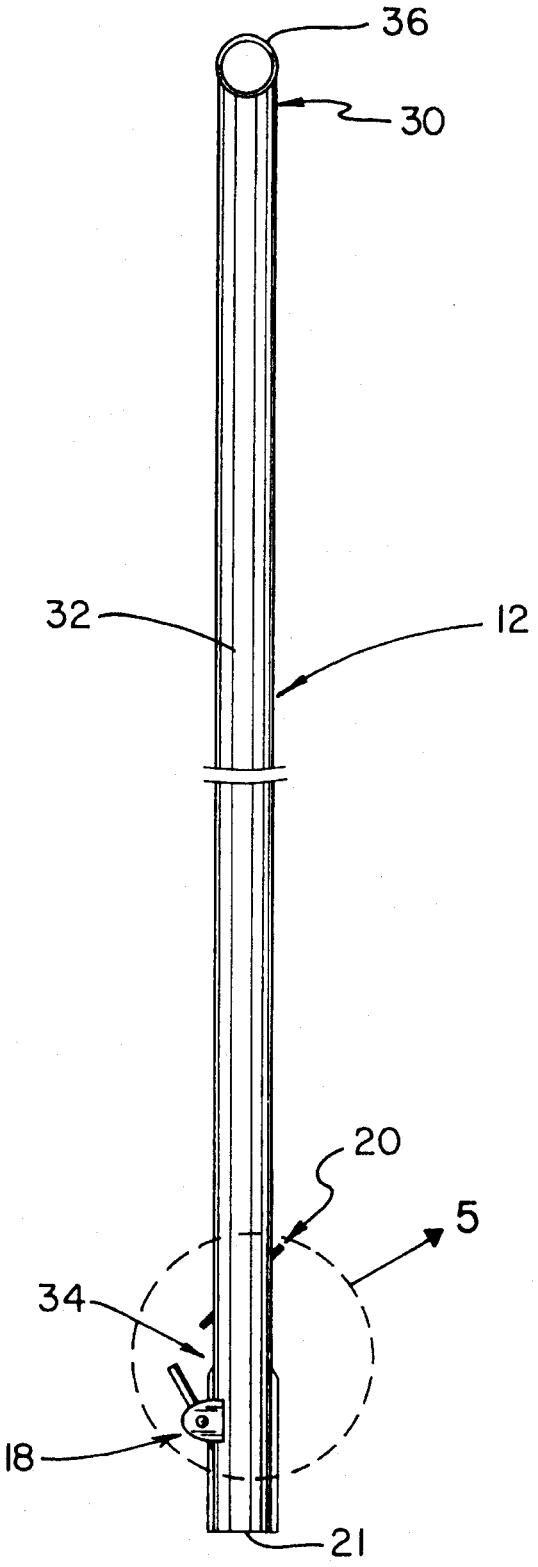
FIG. 2 is a fragmentary side elevational view of the ground rod driver.
Figure 3:
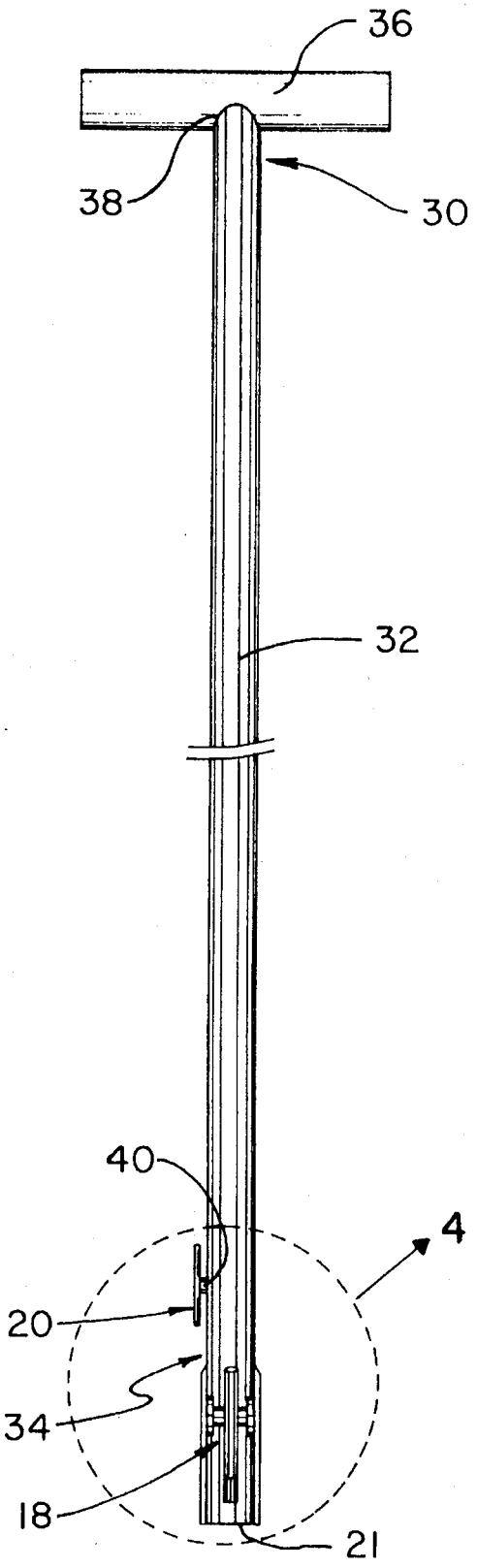
FIG. 3 is side elevational view of the ground rod driver.

More specifically, it will be noted that the ground rod driver 10 comprises a tubular ground rod receiver 12 having a first end portion 30, a central portion 32, and a second end portion 34. See FIGS. 2 and 3. The composition of tubular ground rod receiver 12 is steel, and decorative and protective paints or coating may be applied thereupon. Central portion 32 comprises a substantially tubular structure having a free central opening of dimension adequate for receipt of any diameter ground rod. The free central opening 32 may be eleven sixteenths inches in diameter for a suitable ground rod driver 10 having a cylindrical central portion. An overall length of central portion 32 is six feet five inches, however, longer and shorter lengths may be employed as differing ground rod lengths are occasionally encountered wherein ground rod earth engagements ranging from four feet to twenty feet are encountered. Central portion 32 may be of cylindrical or substantially rectangular cross section and has sufficient sidewall thickness to prevent buckling or collapse during application of force by prime mover 14.

First end portion 30 comprises a prime mover engagement member 36 affixed to the first end portion 30 by a welded joint 38. Other joining techniques such as bolts or clips may be employed to strongly bond central portion 32 and prime mover engagement member 36. Prime mover engagement member 36 comprises a short tubular structure having circular or rectangular cross section. A bolt or pinlike member may be slidably positioned interior to the prime mover engagement member 36 and furthermore the bolt or pinlike member detachably engages a through hole pair disposed upon the prime mover thereby permitting lifting of the ground rod driver 10 free of the earth and, after a brief swinging oscillation which may be manually damped, produces a substantially normal alignment of the ground rod driver 10 with respect to the earth surface. An alternate form of prime mover engagement member 36 includes a flattened plate having a plurality of cliplike members affixed thereon. The cliplike members engage a bolt or pinlike member affixed in a substantially horizontal disposition upon the prime mover.

Second end portion 34 comprises an extension of tubular central portion 32 wherein a threaded through hole 40 and a slot 42 penetrates a sidewall of the tubular ground rod receiver 12. A plurality of ribs 21 are affixed longitudinally to the outer surface of second end portion 32 thereby providing added strength to compensate for possible weakening associated with introduction of slot 42. Clamping setscrew 20 threadedly engages through hole 40 wherein engagement is typically provided by five eighth inch coarse threads disposed therein. Other thread sizes and gauges are equivalently applicable for use in through hole 40. Ground rod engaging assembly 18 is permanently affixed to a sidewall exterior at a site wherein access to slot 42 is provided. A buildup or threaded sleeve is generally applied to strengthen tubular central portion 32.

Figure 4:
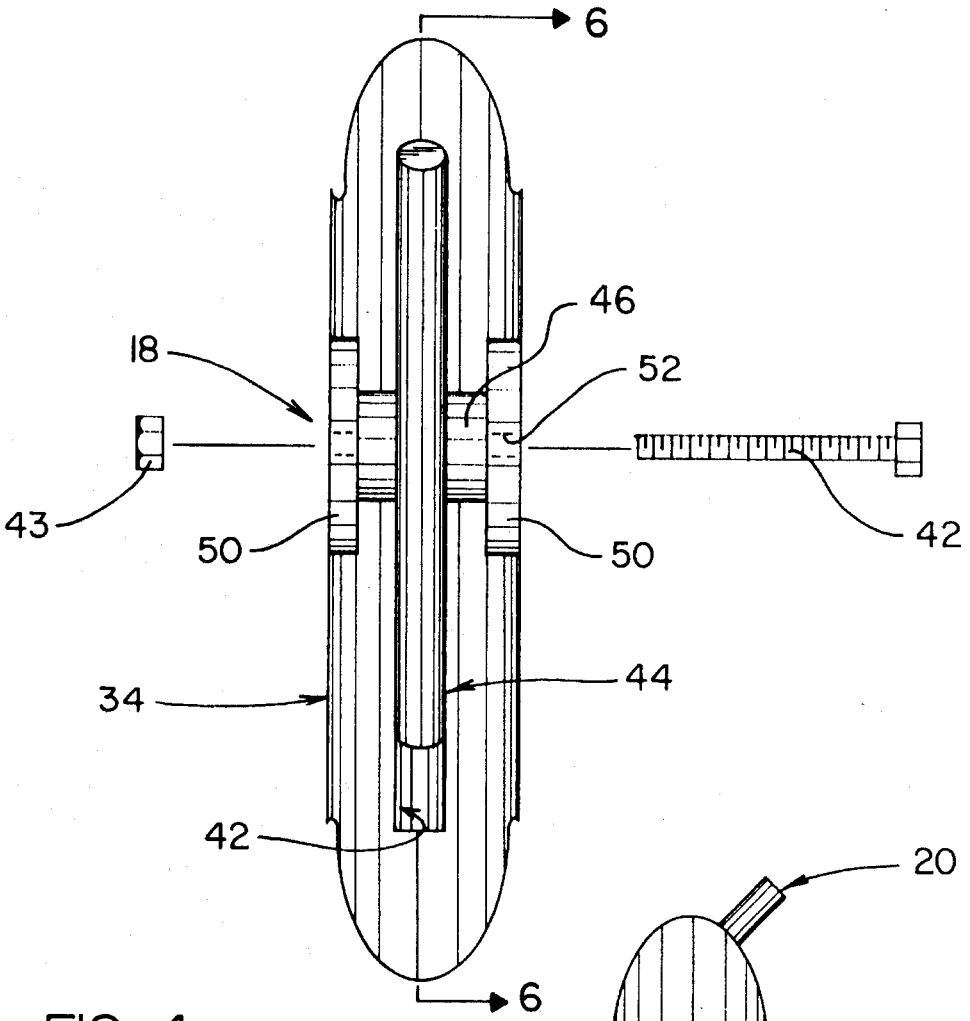
FIG. 4 is an exploded fragmentary side elevational view of the ground rod driver showing an encircled portion designated by the numeral 4 of FIG. 3.
Figure 5:
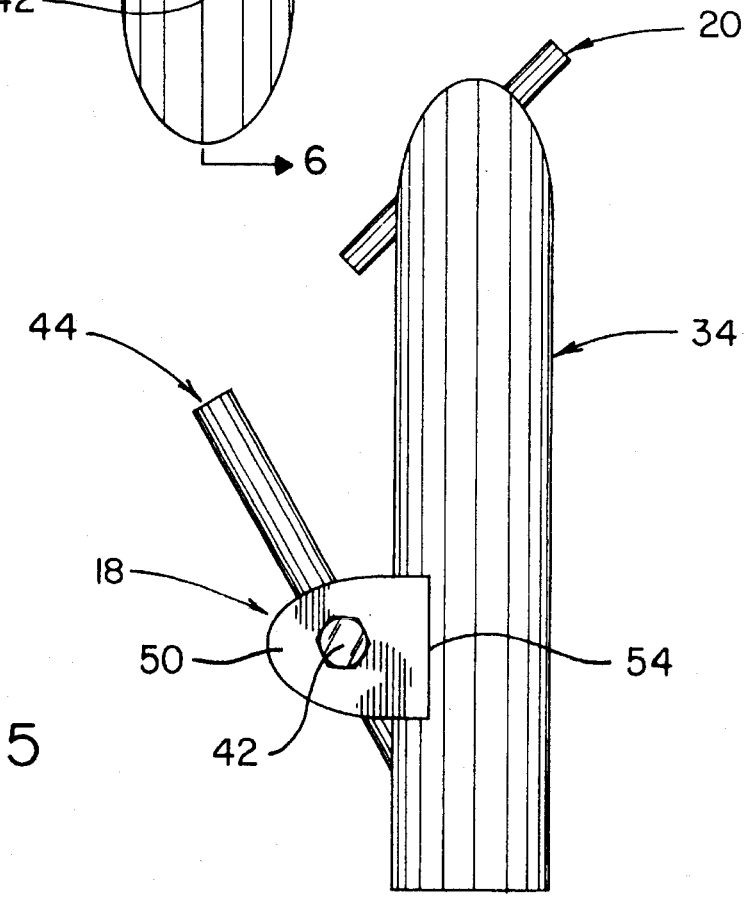
FIG. 5 is a fragmentary side elevational view of a ground rod driver showing an encircled portion designated by the numeral 5 of FIG. 2.

The axis of the buildup or threaded sleeve is substantially coincident with the axis of through hole 40 and threads disposed therein are formed continuously with those of through hole 40. The buildup or threaded sleeve is employed to make through hole 40 operably durable within the relatively harsh construction environment. Rod engaging assembly 18 comprises two fulcrum members 50, through bolt 42 and engaging nut 43, pivoting cam member 44, and spacers 46. See FIGS. 4 and 5.

Figure 6:
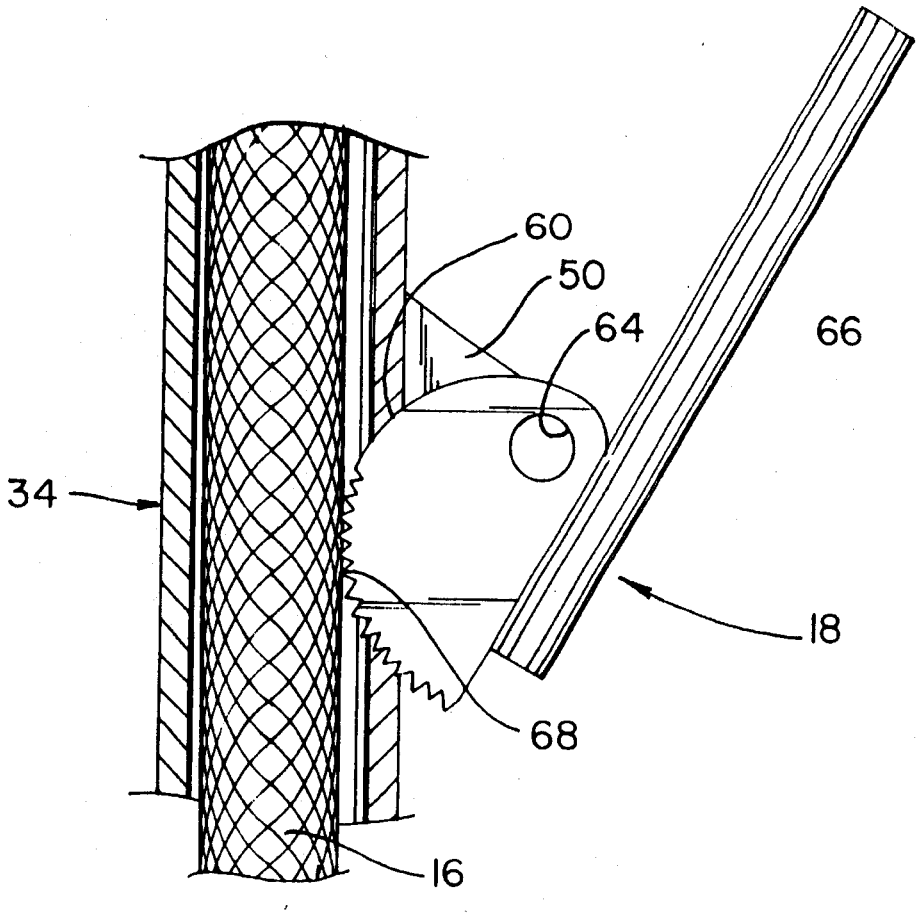
FIG. 6 is a fragmentary side sectional view of the ground rod driver taken substantially upon the plane indicated by the section line 6—6 of FIG. 4.

Fulcrum members 50 comprise substantially flattened plates having a through hole disposed therein through which bolt 42 passes, and a welded joint 54 affixing a fulcrum member 50 to second end portion 34. Pivoting cam member 44 comprises a cam surface 60 having a constant or variable radius of curvature, teeth 62 disposed upon a portion of cam surface 60, through hole 64, and release and gravity engagement handle 66. See FIG. 6. In operation a ground rod 16 engages teeth 62 and rotates pivoting cam member 44 about bolt 42 which passes through hole 64 when prime mover 14 force is applied and ground rod 16 engages the earth. Rotation of pivoting cam member 44 results in increasing engagement of teeth 62 with ground rod 16 and increases frictional engagement of ground rod 16 with the inside walls of second end portion 34. At some juncture relative motion of ground rod 16 and second end portion 34 ceases and the prime mover 14 supplies force as required to insert the ground rod 16 into the earth.

Upon approaching the earth surface with second end portion 34 the prime mover 14 is halted and motion is reverses. The reversal of force upon second portion 34 releases the ground rod 16 from firm engagement with teeth 62 and the pivoting cam member 44 disengages from the ground rod and slides to a new position wherein prime mover motion is again a downward thrust. Gravity engagement handle 66 provided a force resulting from gravity tending to rotate the pivoting cam member 44 into engagement with ground rod 16 and thereby aids in the initial engagement of pivoting cam member 44 with ground rod 16 whenever any downward thrust is begun. Gravity engagement handle 66 may also be employed to manually release a ground rod 16 if release is desired at any stage of installation. Pivoting cam member radius of curvature may be tailored to more quickly engage ground rods and provide an optimal interaction zone for engaging ground rod 16.

Figure 7:
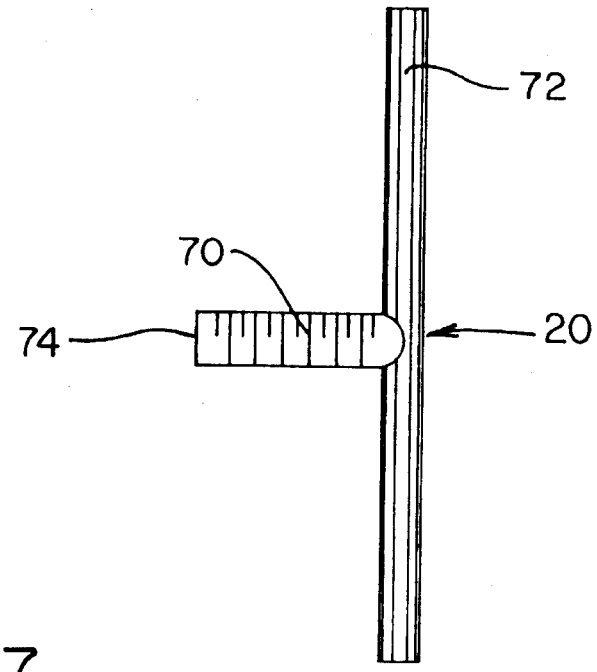
FIG. 7 is a side elevational view of ground rod driver showing a clamping setscrew.

Clamping setscrew 20 comprises a T-shaped handle having a threaded portion 70 and an orthogonally disposed rod portion 72. See FIG. 7. Threaded portion 70 engages through hole 40 and therefore is of mating diameter and thread type. End 74 of threaded portion 70 may be terminated in a point, cup, or other shape devised to frictionally engage the ground rod 16 with minimal operator effort.

In an alternate embodiment, the prime mover engagement member 36 is affixed to a side of tubular ground rod receiver 12 thereby permitting ground rods of indeterminate length to be received therein for the purpose of installation using the ground rod driver. In operation a long ground rod 16 would be inserted within tubular ground rod receiver 12 such that a free end protrudes a substantial distance past the prime mover engagement member 36.

In yet another alternate embodiment the second end portion 34 comprises a separate part of robust construction having a substantially rectangular cross section and connecting to central portion 32 by welds or removably fastening means such as threaded engagement. A typical alternate second end portion 34 comprises a rectangular block having a six inch overall length and a two inch square cross sectional dimension. One end of the rectangular block is formed into a cylinder having a height of one inch, and a pipelike tubular central portion 32 is threadedly affixed therein. Through hole 40 is formed approximately two and three eights inches from a free end of alternate second end portion 34 and fulcrum members 50 are affixed one and three quarters inch from the free end thereof. Weight added to second end portion 34 by inclusion of the aforementioned robust construction will aid in generating a damped pendulum type vertical alignment of the ground rod driver 10.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention. In as much as the present disclosure includes that contained in the appended claims as well as that of the foregoing description. Although this invention has been described in its preferred forms with a certain degree of particularity, it is understood that the present disclosure of the preferred form has been made only by way of example and numerous changes in the details of construction and combination and arrangement of parts may be resorted to without departing from the spirit and scope of the invention.

What is claimed as being new and desired to be protected by LETTERS PATENT of the United States is as follows:

1. A new and improved ground rod driver for installing electrical ground rods in the earth comprising:

an elongated steel prime mover engagement means;

a short tubular steel prime mover engagement member detachably pivotally affixed to an end of the prime mover engagement means;

an elongated tubular steel ground rod receiver coated with a layer of paint and having an inner surface, an outer surface, a first end portion affixed to the prime mover engagement member by a welded joint, a central portion having a length of between about four feet to twenty feet, and a second end portion further having a free opening with a diameter of about eleven sixteenth inches for slidably receiving a ground rod therein, a through hole formed thereon, a slot formed thereon at a location between the through hole and the opening, and a plurality of ribs affixed longitudinally to the outer surface thereof for providing added strength thereto;

a steel rod engagement assembly operatively affixed to the second end portion of the tubular ground rod receiver wherein access to the slot of the ground rod receiver is provided, the rod engagement assembly having two spaced aligned fulcrum members each formed of substantially flattened plates with a through hole disposed thereon and with each plate coupled to the outer surface of the second end portion of the ground rod receiver with a welded joint, an elongated pivoting cam member with a through hole disposed thereon positioned between the fulcrum members and pivotally secured therebetween with a threaded bolt extended within the through hole thereof and extended within the through holes of the fulcrum member and secured with an engaging nut and with the cam member further having a cam surface formed of a substantially semicircular plate with a constant radius of curvature and a plurality of teeth formed upon at least half of a curving perimeter thereof and with the teeth of the cam surface extended through the slot on the second end portion of the ground rod receiver for engaging a ground rod slidably disposed therein and wherein rotation of the cam member in one direction results in increasing ground rod engagement and rotation in an opposing direction results in decreasing ground rod engagement; and a steel clamping setscrew having a T-shaped handle and a threaded portion threadedly affixed within the through hole of the tubular ground rod receiver and with the threaded portion used to frictionally engage and provide attachment of the ground rod with the ground rod receiver to generate an initial ground rod position and to permit extraction with the prime mover engagement means.

* * * * *